US010480549B2

(12) United States Patent
Fujiwara

(10) Patent No.: US 10,480,549 B2
(45) Date of Patent: Nov. 19, 2019

(54) CYLINDER OPERATING CONDITION MONITORING DEVICE

(71) Applicant: SMC CORPORATION, Chiyoda-ku (JP)

(72) Inventor: Atsushi Fujiwara, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 121 days.

(21) Appl. No.: 15/722,647

(22) Filed: Oct. 2, 2017

(65) Prior Publication Data

US 2018/0094655 A1 Apr. 5, 2018

(30) Foreign Application Priority Data

Oct. 3, 2016 (JP) ..... 2016-195553

(51) Int. Cl.

*F15B 15/28* (2006.01)
*F15B 15/14* (2006.01)
*F15B 19/00* (2006.01)

(52) U.S. Cl.

CPC ..... *F15B 15/2838* (2013.01); *F15B 15/14* (2013.01); *F15B 19/005* (2013.01); *F15B 2211/6313* (2013.01); *F15B 2211/7053* (2013.01); *F15B 2211/765* (2013.01); *F15B 2211/8855* (2013.01)

(58) Field of Classification Search

CPC ..... F15B 15/2838; F15B 19/005; F15B 2211/6313; F15B 11/10

See application file for complete search history.

(56) References Cited

U.S. PATENT DOCUMENTS 7,353,743 B2 * 4/2008 Bugel ..... F15B 9/09 91/392
7,387,061 B2 6/2008 Kobata et al.
7,827,787 B2 * 11/2010 Cherney ..... E02F 9/2203 60/414
10,072,676 B2 * 9/2018 Afshari ..... F15B 7/006
2003/0187595 A1 10/2003 Koshinaka et al.
2004/0261608 A1 * 12/2004 Bugel ..... F15B 9/09 91/465

(Continued)

FOREIGN PATENT DOCUMENTS

JP 56-39850 A 4/1981
JP 7-182049 A 7/1995

(Continued)

OTHER PUBLICATIONS

U.S. Appl. No. 16/097,029, filed Oct. 26, 2018, Fujiwara, A.

*Primary Examiner* — Thomas E Lazo
(74) *Attorney, Agent, or Firm* — Oblon, McClelland, Maier & Neustadt, L.L.P.

(57) ABSTRACT

A microcomputer of a detector that constitutes part of a monitoring device calculates differential pressures (first differential pressure, second differential pressure) between a first pressure value detected by a first pressure sensor provided in a first tube and a second pressure value detected by a second pressure sensor provided in a second tube, and on the basis of the calculated differential pressure, determines whether or not a reciprocating motion operation of the piston is in an intermediate state between a normal state and an abnormal state.

6 Claims, 10 Drawing Sheets

(56) References Cited

U.S. PATENT DOCUMENTS

| | | | | |
|---|---|---|---|---|
| 2007/0209503 | A1* | 9/2007 | Pfaff | F15B 11/006 91/433 |
| 2012/0131912 | A1* | 5/2012 | Fukui | B64C 13/42 60/405 |
| 2015/0007713 | A1* | 1/2015 | Aki | G01M 13/00 91/1 |
| 2015/0354172 | A1* | 12/2015 | Hijikata | F15B 11/024 60/414 |
| 2016/0298659 | A1 | 10/2016 | Batenburg et al. | |
| 2018/0266415 | A1* | 9/2018 | Afshari | F15B 7/006 |

FOREIGN PATENT DOCUMENTS

| | | | |
|---|---|---|---|
| JP | 2003-71600 | A | 3/2003 |
| JP | 2003-294503 | A | 10/2003 |
| JP | 3857187 | | 12/2006 |
| JP | 2010-71349 | A | 4/2010 |
| JP | 2010-159783 | A | 7/2010 |
| JP | 5331986 | B2 | 10/2013 |
| JP | 2015-14990 | | 1/2015 |

* cited by examiner

CYLINDER OPERATING CONDITION MONITORING DEVICE

CROSS-REFERENCE TO RELATED APPLICATION

This application is based upon and claims the benefit of priority from Japanese Patent Application No. 2016-195553 filed on Oct. 3, 2016, the contents of which are incorporated herein by reference.

BACKGROUND OF THE INVENTION

Field of the Invention

The present invention relates to a cylinder operating condition monitoring device for a cylinder, which includes a cylinder main body, a piston capable of undergoing reciprocating motion between one end and another end in the interior of the cylinder main body, and a piston rod connected integrally with the piston.

Description of the Related Art

A cylinder includes a cylinder main body, a piston that undergoes reciprocating motion between one end and another end inside the cylinder main body, and a piston rod connected integrally with the piston. A first cylinder chamber is formed between the piston and the one end in the interior of the cylinder main body, and a second cylinder chamber is formed between the piston and the other end in the interior of the cylinder main body. In this instance, by supplying a fluid from a fluid supply source to the first cylinder chamber, or by supplying the fluid to the second cylinder chamber, the piston and the piston rod are made to undergo reciprocating motion between the one end and the other end inside the cylinder main body. In Japanese Patent No. 3857187, a cylinder of this type is disclosed, in which a magnet is incorporated in the piston rod, and position detecting sensors which detect magnetism from the magnet are disposed at the one end and the other end of the cylinder main body.

SUMMARY OF THE INVENTION

However, with the technique of Japanese Patent No. 3857187, since the position detecting sensors are installed in the vicinity of the cylinder, in the case that the cylinder were used, for example, as equipment related to food preparation, and if the cylinder were brought into contact with a cleaning liquid for such food or the like, a possibility exists that the position detecting sensors and associated wiring for the position detecting sensors could become corroded. Thus, if it were attempted to ensure liquid resistance of the position detecting sensors and the wiring therefor, costs would rise.

In addition, with the technique of Japanese Patent No. 3857187, the movement time of the piston between the one end and the other end in the cylinder main body is measured, and when the measured movement time deviates from a regulated value, such a deviation is counted as an error. In addition, if the number of counted errors reaches or exceeds an allowable error count, a failure of the cylinder is determined to have occurred. Consequently, concerning the reciprocating motion operation of the piston, no judgment criterion is disclosed with respect to an intermediate state between a normal state and an abnormal state. As a result, it is not possible to determine such an intermediate state in which the performance of the piston has deteriorated from its initial state, even during normal operation of the cylinder.

The present invention has been devised as a solution to the aforementioned problems, and an object of the present invention is to provide a cylinder operating condition monitoring device, in which it is possible to determine an intermediate state between a normal state and an abnormal state, without requiring a sensor to be installed in the vicinity of the cylinder.

The present invention relates to an operating condition monitoring device for a cylinder, in which a first cylinder chamber is formed between a piston and one end in the interior of a cylinder main body, a second cylinder chamber is formed between the piston and another end in the interior of the cylinder main body, and fluid is supplied from a fluid supply source to the first cylinder chamber, or fluid is supplied from the fluid supply source to the second cylinder chamber, whereby the piston which is connected to a piston rod undergoes reciprocating motion between the one end and the other end inside the cylinder main body.

In addition, in order to attain the object described above, the operating condition monitoring device for a cylinder according to the present invention comprises a first pressure detection unit adapted to detect a pressure value of the first cylinder chamber, a second pressure detection unit adapted to detect a pressure value of the second cylinder chamber, a differential pressure calculating unit adapted to calculate a differential pressure between the pressure value detected by the first pressure detection unit and the pressure value detected by the second pressure detection unit, and a determination unit adapted to determine, on the basis of the differential pressure calculated by the differential pressure calculating unit, whether or not the reciprocating motion operation of the piston is in an intermediate state between a normal state and an abnormal state.

In accordance with such a configuration, if the pressure in the fluid supply path from the fluid supply source to the first cylinder chamber or the second cylinder chamber is detected, it becomes possible to detect the pressure value of the first cylinder chamber or the second cylinder chamber. Consequently, according to the present invention, it is unnecessary to install sensors in the vicinity of the cylinder.

Further, the determination unit determines whether or not the reciprocating motion operation of the piston is in an intermediate state, based on the differential pressure between the pressure value of the first cylinder chamber and the pressure value of the second cylinder chamber. In this manner, by adding such a determination process (failure prediction function) with respect to the intermediate state, even at times of normal operation, it is possible to determine the intermediate state in which the performance of the cylinder has deteriorated from its initial state.

In this instance, the operating condition monitoring device may further include a storage unit adapted to store the calculated differential pressure, in the event that, during reciprocating motion of the piston, the first pressure detection unit has detected the pressure value of the first cylinder chamber, the second pressure detection unit has detected the pressure value of the second cylinder chamber, and the differential pressure calculating unit has calculated the differential pressure of the respective pressure values. In this case, at completion of the reciprocating motion operation, the determination unit determines whether or not the reciprocating motion operation is in the intermediate state based on the differential pressure that is stored in the storage unit.

In accordance with this feature, since the differential pressure, which is calculated during the reciprocating motion, is analyzed at completion of the reciprocating motion operation, it is possible to determine with high accuracy whether or not the reciprocating motion operation is in the intermediate state. As a result, the reliability of the determination result can be enhanced.

Further, it is known that the differential pressure during reciprocating motion of the piston remains substantially constant. Therefore, a change in the level of the differential pressure can be regarded as indicating that an abnormality has occurred, such as a deterioration in performance or a breakdown of (components related to operation of) the cylinder. Accordingly, by carrying out such a determination based on the differential pressure, it is possible to perform the determination process highly efficiently with respect to the reciprocating motion operation.

Further, the fluid supply source supplies fluid to the first cylinder chamber through a first tube, or supplies fluid to the second cylinder chamber through a second tube. In this case, the first pressure detection unit may detect a first pressure value of the fluid inside the first tube, which is dependent on the pressure value of the first cylinder chamber, the second pressure detection unit may detect a second pressure value of the fluid inside the second tube, which is dependent on the pressure value of the second cylinder chamber, and the differential pressure calculating unit may calculate a differential pressure between the first pressure value and the second pressure value.

In accordance with this feature, the determination process can be performed with good efficiency utilizing the differential pressure, which is based on the first pressure value and the second pressure value. Further, because the first pressure detection unit is provided in the first tube, together with the second pressure detection unit being provided in the second tube, it is unnecessary to install sensors, as well as wiring for such sensors, in the vicinity of the cylinder. As a result, it is possible for the cylinder to be used suitably in facilities related to food preparation, and it is possible to avoid the occurrence of corrosion or the like of sensors and wiring in a cleaning process for the facilities.

In addition, the determination unit determines that the reciprocating motion operation of the piston is in the normal state, in the case that the differential pressure is less than a first differential pressure threshold value. Further, the determination unit determines that the reciprocating motion operation is in the intermediate state in which a degradation in performance of the cylinder has occurred although the reciprocating motion operation is normal, in the case that the differential pressure is greater than or equal to the first differential pressure threshold value and less than a second differential pressure threshold value. Furthermore, the determination unit determines that the reciprocating motion operation of the piston is in the abnormal state, in the case that the differential pressure is greater than or equal to the second differential pressure threshold value.

In accordance with this feature, concerning the reciprocating motion operation, the determination unit is capable of carrying out determinations, respectively, of the normal state, the intermediate state, and the abnormal state. Further, because the determination process (failure prediction function) with respect to the intermediate state is carried out using as reference values the first differential pressure threshold value and the second differential pressure threshold value, even during normal operation, it is possible to easily determine the intermediate state in which the performance has deteriorated from the initial state.

Furthermore, the operating condition monitoring device further comprises a timer unit adapted to measure a movement time of the piston between the one end and the other end inside the cylinder main body. In this case, the timer unit may measure as the movement time a time zone from a point in time at which the piston starts moving from the one end or the other end inside the cylinder main body to a point in time at which the piston reaches the other end or the one end inside the cylinder main body, and the differential pressure increases from a constant value, and the determination unit may determine whether or not the reciprocating motion operation of the piston is in the intermediate state based on the movement time.

If the movement time changes, such a change can be regarded as indicating that an abnormality has occurred, such as a deterioration in performance or a breakdown of (components related to operation of) the cylinder, and therefore, based on the movement time, it is possible to perform the determination process highly efficiently with respect to the reciprocating motion operation.

In addition, the determination unit determines that the reciprocating motion operation of the piston is in a normal state, in the case that the movement time lies within a first time period threshold value. Further, the determination unit determines that the reciprocating motion operation is in the intermediate state in which degradation in performance of the cylinder has occurred although the reciprocating motion operation is normal, in the case that the movement time deviates from the first time period threshold value and lies within a second time period threshold value. Furthermore, the determination unit determines that the reciprocating motion operation is in the abnormal state, in the case that the movement time deviates from the second time period threshold value.

In this case as well, concerning the reciprocating motion operation, the determination unit is capable of carrying out determinations, respectively, of the normal state, the intermediate state, and the abnormal state. Further, because the determination process (failure prediction function) with respect to the intermediate state is carried out using as reference values the first time period threshold value and the second time period threshold value, even during normal operation, it is possible to easily determine the intermediate state in which the performance has deteriorated from the initial state.

Further, the operating condition monitoring device may further include a notification unit adapted to provide a notification of the determination result of the determination unit.

If the above-described intermediate state is treated as a warning state with respect to an abnormality such as a failure or the like, before the cylinder actually suffers from a failure, deterioration in performance of the cylinder can be notified to an upper level system or the like of the operating condition monitoring device. Consequently, it is possible to provide a notification to a user concerning a maintenance timing for the cylinder, and to minimize downtime of the system as a whole.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a cylinder operating condition monitoring device according to the present invention will be described in detail below with reference to the drawings.

[1. Configuration of the Present Embodiment]

Figure 1:
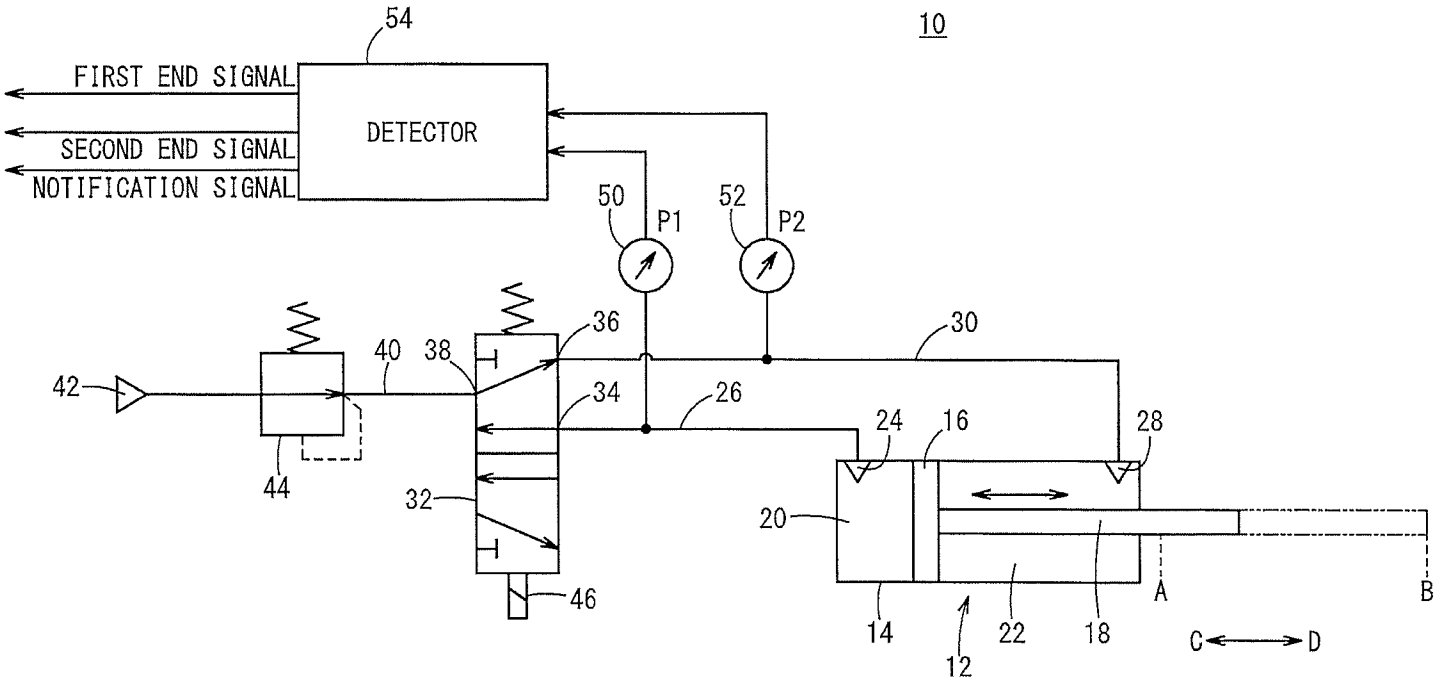
FIG. 1 is a block diagram of a monitoring device according to a present embodiment.

FIG. 1 is a block diagram of a cylinder operating condition monitoring device 10 (hereinafter, also referred to simply as a "monitoring device 10") according to the present embodiment. The monitoring device 10 functions as a device for monitoring the operating condition of a cylinder 12.

The cylinder 12 includes a cylinder main body 14, a piston 16 disposed movably in the interior of the cylinder main body 14, and a piston rod 18 that is connected to the piston 16. In this case, in the interior of the cylinder main body 14, a first cylinder chamber 20 is formed between the piston 16 and one end shown on the left side in FIG. 1, and a second cylinder chamber 22 is formed between the piston 16 and another end shown on the right side in FIG. 1.

Moreover, as shown in FIG. 1, the piston rod 18 is connected to a side surface of the piston 16 that faces toward the second cylinder chamber 22, and the distal end of the piston rod 18 extends outwardly from the right end of the cylinder main body 14. Therefore, it can be understood that the cylinder 12 is a single shaft type of cylinder.

A first port 24 is formed on a side surface of the cylinder main body 14 on the side of the first cylinder chamber 20, and one end part of a first tube 26 is connected to the first port 24. On the other hand, a second port 28 is formed on a side surface of the cylinder main body 14 on the side of the second cylinder chamber 22, and one end part of a second tube 30 is connected to the second port 28.

Another end part of the first tube 26 is connected to a first connection port 34 of a changeover valve 32. Further, another end part of the second tube 30 is connected to a second connection port 36 of the changeover valve 32. A supply tube 40 is connected to a supply port 38 of the changeover valve 32. The supply tube 40 is connected to a fluid supply source 42, and a pressure reducing valve 44 is provided at a midway location in the supply tube 40.

The changeover valve 32 is a five port single acting type of solenoid valve, and is driven by command signals (currents) being supplied to a solenoid 46 from the exterior.

More specifically, when a command signal is not supplied to the solenoid 46, the supply port 38 and the second connection port 36 communicate with each other, together with the first connection port 34 being opened to the exterior. Consequently, the fluid supplied from the fluid supply source 42 is converted into a predetermined pressure by the pressure reducing valve 44, and is supplied via the supply tube 40 to the supply port 38 of the changeover valve 32. The pressure-converted fluid (pressure fluid) is supplied to the second cylinder chamber 22 via the supply port 38, the second connection port 36, the second tube 30, and the second port 28.

As a result, the piston 16 is pressed by the pressure fluid toward the side of the first cylinder chamber 20, and moves in the direction of the arrow C. Together therewith, the fluid (pressure fluid) inside the first cylinder chamber 20, which is pressed by the piston 16, is discharged to the exterior from the first port 24 via the first tube 26, the first connection port 34, and the changeover valve 32.

On the other hand, when a command signal is supplied to the solenoid 46, the supply port 38 and the first connection port 34 communicate with each other, together with the second connection port 36 being opened to the exterior. Consequently, the pressure fluid that was supplied from the fluid supply source 42, and which was converted into a predetermined pressure by the pressure reducing valve 44, is supplied to the first cylinder chamber 20 from the supply tube 40, via the supply port 38, the first connection port 34, the first tube 26, and the first port 24.

As a result, the piston 16 is pressed by the pressure fluid toward the side of the second cylinder chamber 22, and moves in the direction of the arrow D. Together therewith, the fluid inside the second cylinder chamber 22, which is pressed by the piston 16, is discharged to the exterior from the second port 28 via the second tube 30, the second connection port 36, and the changeover valve 32.

In this manner, due to the switching operation of the changeover valve 32, the pressure fluid is supplied from the fluid supply source 42 to the first cylinder chamber 20 via the first tube 26, or the pressure fluid is supplied from the fluid supply source 42 to the second cylinder chamber 22 via the second tube 30, whereby the piston 16 and the piston rod 18 are capable of undergoing reciprocal motion in the direction of the arrow C and the direction of the arrow D. More specifically, the cylinder 12 is a double acting type of cylinder.

Moreover, in the present embodiment, a distal end position of the piston rod 18 when the piston 16 has moved to the one end in the direction of the arrow C in the interior of the cylinder main body 14 is defined as a position A, whereas the distal end position of the piston rod 18 when the piston 16 has moved to the other end in the direction of the arrow D in the interior of the cylinder main body 14 is defined as a position B. Further, in the following description, a case in which the piston 16 moves from one end to the other end inside the cylinder main body 14 along the direction of the arrow D at a time that current is supplied to the solenoid 46 (when the changeover valve 32 is on) is also referred to as "advancing". Furthermore, in the case that the piston 16 reaches the other end inside the cylinder main body 14, and the distal end position of the piston rod 18 arrives at the position B, the other end, which is a stroke end, and the position B are both referred to as a "first end".

On the other hand, in the following description, a case in which the piston 16 moves from the other end to the one end inside the cylinder main body 14 along the direction of the arrow C at a time that current is not supplied to the solenoid 46 (when the changeover valve 32 is off) is also referred to as "retracting". Further, in the case that the piston 16 reaches the one end inside the cylinder main body 14, and the distal end position of the piston rod 18 arrives at the position A, the one end, which is a stroke end, and the position A are both referred to as a "second end".

Further, in the present embodiment, the changeover valve 32 is not limited to being the solenoid valve shown in FIG. 1, but may be another known type of solenoid valve. Further, in place of a single acting solenoid valve, for the changeover valve 32, a well known type of double acting solenoid valve may also be used. In the description to be given below, a case will be described in which the five port single acting type of solenoid valve shown in FIG. 1 serves as the changeover valve 32.

In a case in which the cylinder 12 is configured in the foregoing manner, in addition to the fluid supply source 42, the pressure reducing valve 44, and the changeover valve 32, etc., the monitoring device 10 according to the present embodiment further includes a first pressure sensor 50 (first pressure detection unit), a second pressure sensor 52 (second pressure detection unit), and a detector 54.

The first pressure sensor 50 sequentially detects a pressure value (first pressure value) P1 of the pressure fluid inside the first tube 26, and outputs to the detector 54 a first pressure signal corresponding to the detected first pressure value P1. The second pressure sensor 52 sequentially detects a pressure value (second pressure value) P2 of the pressure fluid inside the second tube 30, and outputs to the detector 54 a second pressure signal corresponding to the detected second pressure value P2.

Moreover, because the first tube 26 is connected to the first cylinder chamber 20, the first pressure value P1 is a pressure value that corresponds to a pressure value of the first cylinder chamber 20. Further, because the second tube 30 is connected to the second cylinder chamber 22, the second pressure value P2 is a pressure value that corresponds to a pressure value of the second cylinder chamber 22. Furthermore, various known pressure detecting means can be adopted for the first pressure sensor 50 and the second pressure sensor 52, however, descriptions of these pressure detecting means will be omitted.

In the case that the first pressure signal and the second pressure signal are sequentially input into the detector 54, then on the basis of the first pressure value P1 corresponding to the first pressure signal, and the second pressure value P2 corresponding to the second pressure signal, the detector 54 determines whether or not the piston 16 has reached the one end (second end) or the other end (first end) of the cylinder main body 14. As a result of such a determination process, the detector 54 outputs a signal (first end signal) indicating that the piston 16 has reached the first end, or a signal (second end signal) indicating that the piston 16 has reached the second end.

After completion of the reciprocating motion of the piston 16, and on the basis of the differential pressure between the first pressure value P1 and the second pressure value P2 and/or the movement time T of the piston 16 between the one end and the other end of the cylinder main body 14 when the piston 16 moves between the one end and the other end of the cylinder main body 14, the detector 54 executes a determination process (process of determining an intermediate state prior to failure) of a normal or abnormal (failure) condition of the operating state of the cylinder 12, as well as a process for determining a deterioration in performance of the cylinder 12 from its initial state, and the determination results thereof are notified in the form of a notification signal to the exterior.

The aforementioned determination processes, which are carried out in the detector 54, will be described in detail later.

Figure 2:
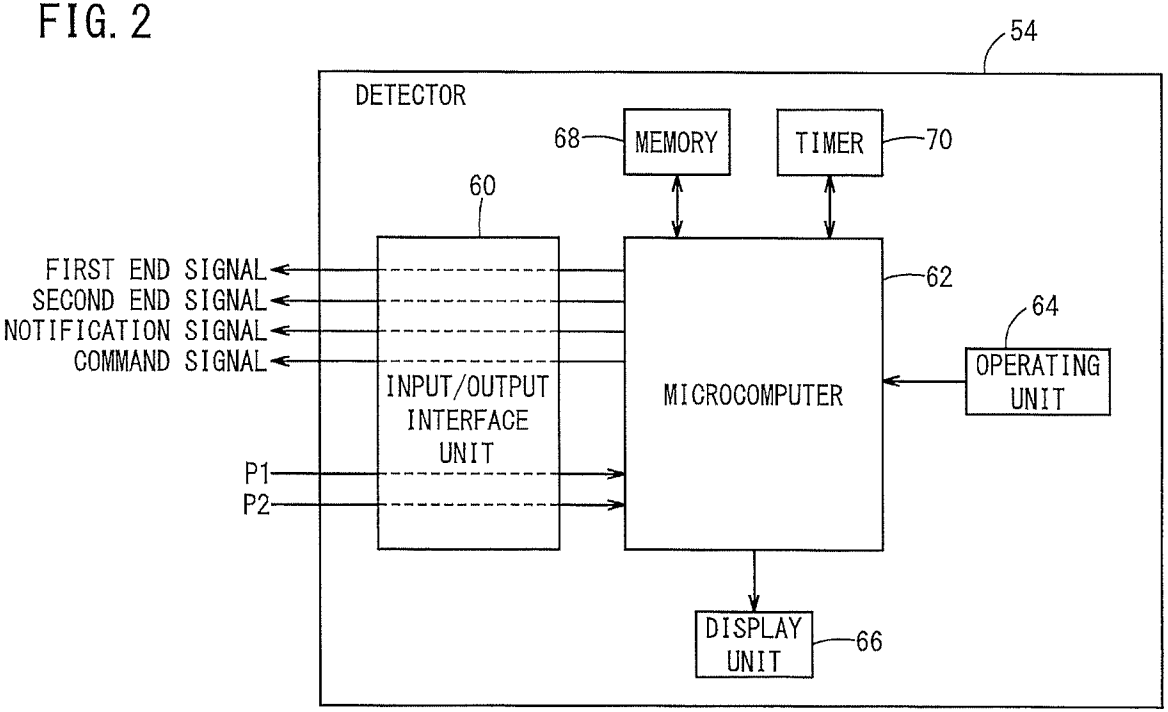
FIG. 2 is a block diagram showing an internal configuration of a detector shown in FIG. 1.

FIG. 2 is a block diagram showing an internal configuration of the detector 54. The detector 54 generates the first end signal or the second end signal by carrying out a predetermined digital signal process (determination process) using the first pressure signal and the second pressure signal.

The detector 54 includes an input/output interface unit 60 (notification unit), a microcomputer 62 (differential pressure calculating unit, determination unit), an operating unit 64, a display unit 66 (notification unit), a memory 68 (storage unit), and a timer 70 (timer unit).

The input/output interface unit 60 successively acquires the first pressure signal and the second pressure signal, and outputs to the microcomputer 62 the first pressure value P1 indicated by the first pressure signal, and the second pressure value P2 indicated by the second pressure signal. Further, as will be described later, in the case that the microcomputer 62 generates the first end signal or the second end signal on the basis of the first pressure value P1 and the second pressure value P2, the input/output interface unit 60 outputs the first end signal or the second end signal to the exterior. Furthermore, in the case that the microcomputer 62 determines the operating state (normal state, abnormal state, or an intermediate state (deterioration in performance prior to failure)) of the cylinder 12, the input/output interface unit 60 outputs a notification signal indicative of the determination result to the exterior (for example, to an upper level computer of the fluid system including the cylinder 12).

The operating unit 64 is an operating means such as an operating panel and an operating button or the like, which are operated by a user of the monitoring device 10 and the cylinder 12. By operating the operating unit 64, the user sets reference values, which are necessary for the digital signal process (determination process) carried out by the microcomputer 62. The set reference values are supplied to the microcomputer 62. Accordingly, by operating the operating unit 64, the user can appropriately set the aforementioned reference values corresponding to the operating environment of the cylinder 12 as well as the type of cylinder 12, and the like. Incidentally, as reference values, the following values (1) to (6) may be considered.

(1) A first reference differential pressure ΔP12ref, which serves as a reference value with respect to a first differential pressure (P1−P2)=ΔP12 between the first pressure value P1 and the second pressure value P2. The first reference differential pressure ΔP12ref represents a minimum value (threshold value) of the first differential pressure ΔP12 at a time that the piston 16 reaches the other end inside the cylinder main body 14. Accordingly, if the first differential pressure ΔP12 is greater than the first reference differential pressure ΔP12ref, it can be determined that the piston 16 has arrived at the other end inside the cylinder main body 14.

(2) A second reference differential pressure ΔP21ref, which serves as a reference value with respect to a second differential pressure (P2−P1)=ΔP21 between the second pressure value P2 and the first pressure value P1. The second reference differential pressure ΔP21ref represents a minimum value (threshold value) of the second differential pressure ΔP21 at a time that the piston 16 reaches the one end inside the cylinder main body 14. Accordingly, if the second differential pressure ΔP21 is greater than the second reference differential pressure ΔP21ref, it can be determined that the piston 16 has arrived at the one end inside the cylinder main body 14.

Figure 8:
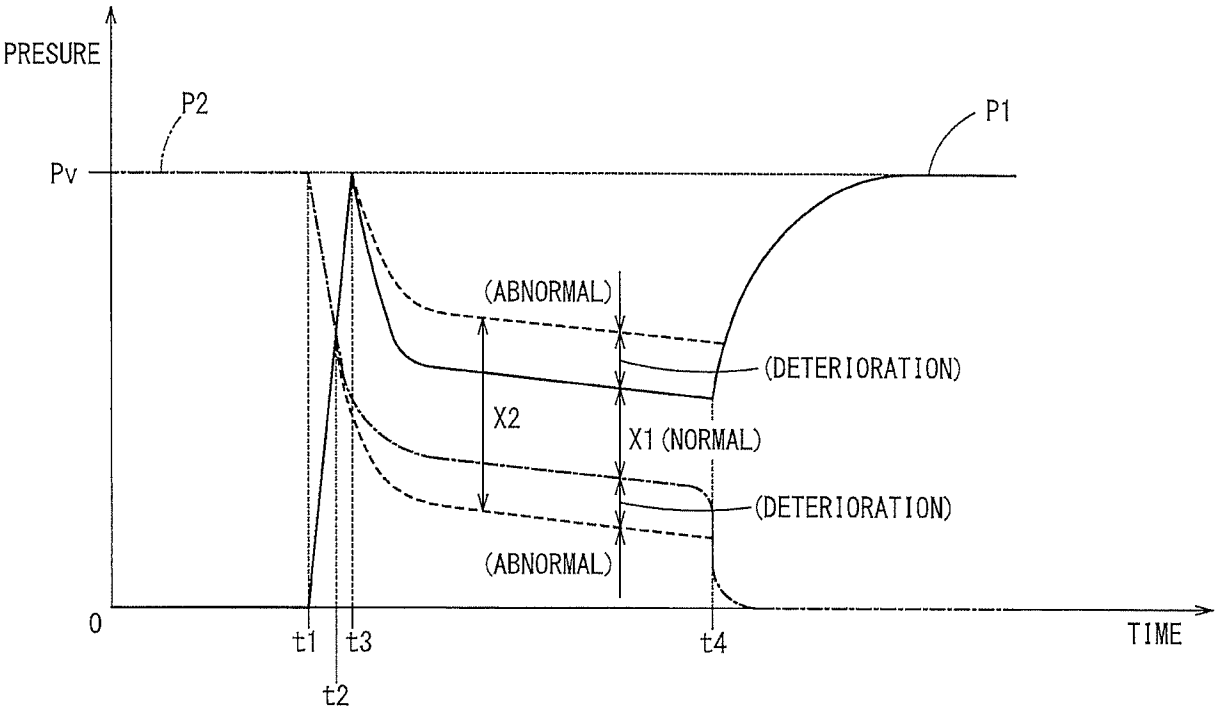
FIG. 8 is a timing chart corresponding to the determination process of the flowchart of FIG. 7.

(3) A first differential pressure threshold value X1, which serves as a first threshold value with respect to the first differential pressure ΔP12 or the second differential pressure ΔP21 when the piston 16 is moving between the one end and the other end of the cylinder main body 14 (see FIG. 8). The first differential pressure threshold value X1 is an upper limit value (threshold value) of the first differential pressure ΔP12 or the second differential pressure ΔP21 at a time that the operation of the cylinder 12 (reciprocating motion of the piston 16) is in a normal state. Accordingly, if the first differential pressure ΔP12 or the second differential pressure ΔP21 is greater than or equal to the first differential pressure threshold value X1, it can be determined that the performance of the cylinder 12 has deteriorated from its initial state, although otherwise the cylinder 12 is operating normally.

(4) A second differential pressure threshold value X2, which serves as a second threshold value with respect to the first differential pressure ΔP12 or the second differential pressure ΔP21 when the piston 16 is moving between the one end and the other end of the cylinder main body 14 (see FIG. 8). The second differential pressure threshold value X2 is a lower limit value (threshold value) of the first differential pressure ΔP12 or the second differential pressure ΔP21 at a time that the operation of the cylinder 12 (reciprocating motion of the piston 16) is in an abnormal state. Accordingly, if the first differential pressure ΔP12 or the second differential pressure ΔP21 is greater than or equal to the second differential pressure threshold value X2, it can be determined that the operation of the cylinder 12 is in an abnormal state (the cylinder 12 has failed).

Figure 10:
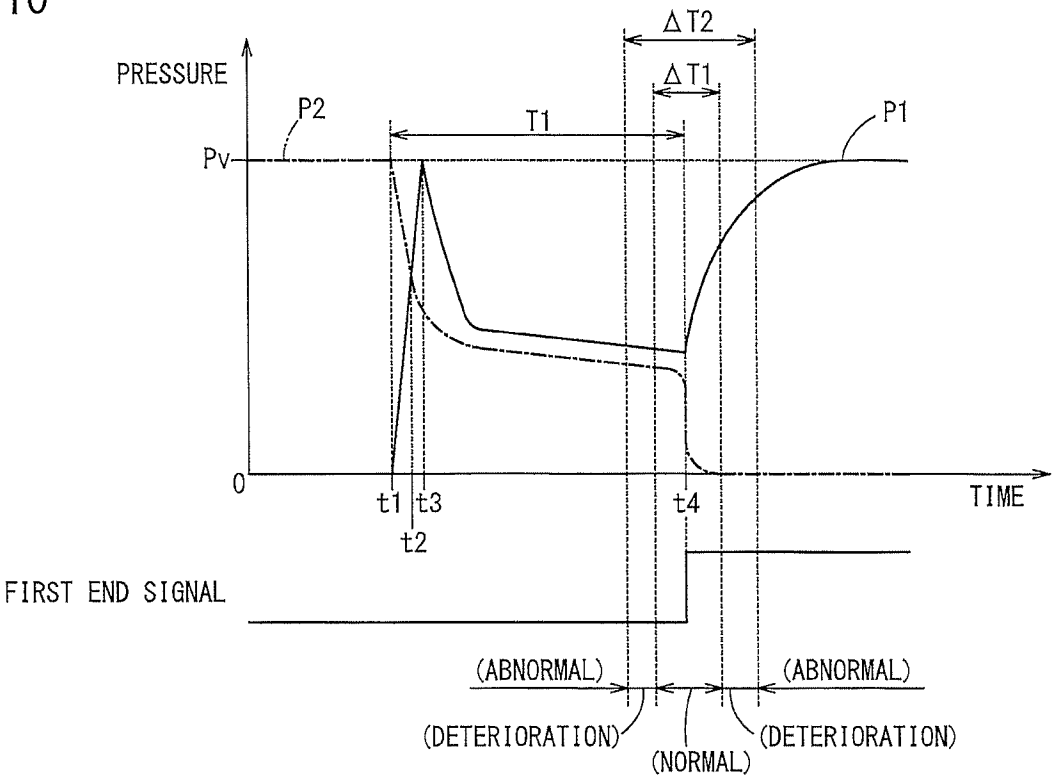
FIG. 10 is a timing chart corresponding to the determination process of the flowchart of FIG. 9.

(5) A first time period threshold value ΔT1, which serves as a first allowable range with respect to a travel time T of the piston 16 (see FIG. 10). The first time period threshold value ΔT1 is a predetermined time range centered about the movement time T0 of the cylinder 12 in its initial state. If the travel time T lies within a range of the first time period threshold value ΔT1, it can be determined that the piston 16 is operating normally (the operation of the cylinder 12 is in a normal state).

(6) A second time period threshold value ΔT2, which serves as a second allowable range with respect to the travel time T of the piston 16 (see FIG. 10). The second time period threshold value ΔT2 is a predetermined time range centered about the movement time T0 of the cylinder 12 in its initial state, and which is set to be longer than the first time period threshold value ΔT1. If the travel time T lies within the second time period threshold value ΔT2, it can be determined that, although the piston 16 is operating normally (operation of the cylinder 12 is normal), the cylinder 12 is in an intermediate state in which the performance of the cylinder 12 has deteriorated from its initial state. Accordingly, if the travel time T deviates from the second time period threshold value ΔT2, it can be determined that the operation of the cylinder 12 is in an abnormal state (the cylinder 12 has failed).

Moreover, the setting operation for each of the reference values is implemented by the user constructing a system including the monitoring device 10 and the cylinder 12, etc., and thereafter, during a trial operation, by the user operating the operating unit 64 while setting the operating conditions for the cylinder 12. Alternatively, each of the reference values may be set or changed through the input/output interface unit 60 by way of communications with the exterior or the like.

The microcomputer 62 performs arithmetic processing on the first pressure value P1 and the second pressure value P2, which are input sequentially from the input/output interface unit 60, and calculates the first differential pressure ΔP12 and the second differential pressure ΔP21. In addition, based on a comparison between the calculated first differential pressure ΔP12 and the calculated second differential pressure ΔP21, and the above-described reference values (the first reference differential pressure ΔP12ref and the second reference differential pressure ΔP21ref), the microcomputer 62 determines whether or not the piston 16 has reached the one end (second end) or the other end (first end) inside the cylinder main body 14.

In the case that the piston 16 has arrived at the other end inside the cylinder main body 14, the microcomputer 62 generates the first end signal, which indicates that the piston 16 and the piston rod 18 have arrived at the first end. On the other hand, in the case that the piston 16 has arrived at the one end inside the cylinder main body 14, the microcomputer 62 generates the second end signal, which indicates that the piston 16 and the piston rod 18 have arrived at the second end. The generated first end signal or the generated second end signal is output to the exterior via the input/output interface unit 60.

In this case, regardless of whether or not the piston 16 has arrived at the one end or the other end inside the cylinder main body 14, each time that the above determination process is performed, the microcomputer 62 stores the determination result together with the first differential pressure ΔP12 and the second differential pressure ΔP21 used in the determination in the memory 68.

Further, via the input/output interface unit 60, the microcomputer 62 is capable of supplying command signals to the solenoid 46 of the changeover valve 32.

Furthermore, in the case that the timer 70 begins measurement at a point in time at which the command signal starts to be supplied from the microcomputer 62 to the solenoid 46, and the timer 70 measures the movement time T from that point in time up until the piston 16 arrives at the first end, the microcomputer 62 stores the movement time T that was measured by the timer 70 in the memory 68.

Moreover, as shown in FIGS. 4, 5, 8, and 10, when the piston 16 begins to move from the one end or the other end inside the cylinder main body 14, and reaches the other end or the one end inside the cylinder main body 14, the first differential pressure ΔP12 or the second differential pressure ΔP21, which has been substantially constant, increases rapidly along with the elapse of time. Accordingly, the movement time T is a time period from the point in time (time t1, t5) at which supply of the command signal is started, up to the point in time (time t4, t8) at which the first differential pressure ΔP12 or the second differential pressure ΔP21 rapidly increases, as a result of the piston 16 arriving at the other end or the one end inside the cylinder main body 14.

In addition, after completion of the reciprocating motion of the piston 16, from among the first differential pressures ΔP12 and the second differential pressures ΔP21 that are stored in the memory 68, the microcomputer 62 reads out first differential pressures ΔP12 and second differential pressures ΔP21, which correspond to a determination result (a determination result during reciprocating motion of the piston 16) that the piston 16 has not yet arrived at the first end or the second end, and on the basis of a comparison between the first differential pressures ΔP12 and the second differential pressures ΔP21 that were read out, and the first differential pressure threshold value X1 and the second differential pressure threshold value X2, the microcomputer 62 determines whether or not the operation of the cylinder 12 is in a normal state or an abnormal state, and furthermore, whether the cylinder 12 is in an intermediate state in which a deterioration in performance of the cylinder 12 is occurring.

Alternatively, after completion of the reciprocating motion of the piston 16, the microcomputer 62 may read out the movement time T that is stored in the memory 68, and on the basis of a comparison between the movement time T that was read out and the first time period threshold value ΔT1 and the second time period threshold value ΔT2, the microcomputer 62 may determine whether or not the operation of the cylinder 12 is in a normal state or an abnormal state, and furthermore, whether the cylinder 12 is in an intermediate state in which a deterioration in performance of the cylinder 12 is occurring.

The microcomputer 62 outputs a notification signal indicative of the determination result (normal state, abnormal state, or intermediate state) to the display unit 66, thereby causing the display unit 66 to display the determination result and notify the user. Alternatively, the notification signal is output, and a notification of the determination is issued to an external upper level computer or the like via the input/output interface unit 60.

The display unit 66 displays the reference values that were set by the user operating the operating unit 64, or displays the results of various determination processes performed by the microcomputer 62. The memory 68 stores each of the reference values that were set by the operation unit 64, the aforementioned determination results, the first differential pressures ΔP12, the second differential pressures ΔP21, and the movement times T. As noted above, the timer 70 measures the movement time T of the piston 16 inside the cylinder main body 14, by starting measurement of time from a point in time at which supply of the command signal from the microcomputer 62 to the solenoid 46 is started.

[2. Operations of the Present Embodiment] The monitoring device 10 according to the present embodiment is basically configured in the manner described above. Next, operations of the monitoring device 10 will be described with reference to FIGS. 3 to 10. Along with this description, as necessary, reference may also be made to FIGS. 1 and 2.

In this instance, during reciprocating motion of the piston 16, and on the basis of a comparison between the first differential pressure ΔP12 (=P1−P2) and the first reference differential pressure ΔP12ref and/or a comparison between the second differential pressure ΔP21 (=P2−P1) and the second reference differential pressure ΔP21ref, in the microcomputer 62, it is repeatedly determined whether or not the piston 16 has reached the one end (second end) or the other end (first end) inside the cylinder main body 14 (steps S1 to S6 of FIG. 3), and the determination results thereof, the first differential pressure ΔP12, the second differential pressure ΔP21 (=P2−P1), and the movement time T are stored sequentially in the memory 68.

In addition, after completion of the reciprocating motion of the piston 16, in the microcomputer 62, using the movement time T, or the first differential pressure ΔP12 and the second differential pressure ΔP21 at a time that the piston 16 is undergoing reciprocating motion between the one end and the other end inside the cylinder main body 14, a determination process (to determine the normal state, the abnormal state, or the intermediate state) is carried out with respect to the operating condition of the cylinder 12 (step S7).

Figure 3:
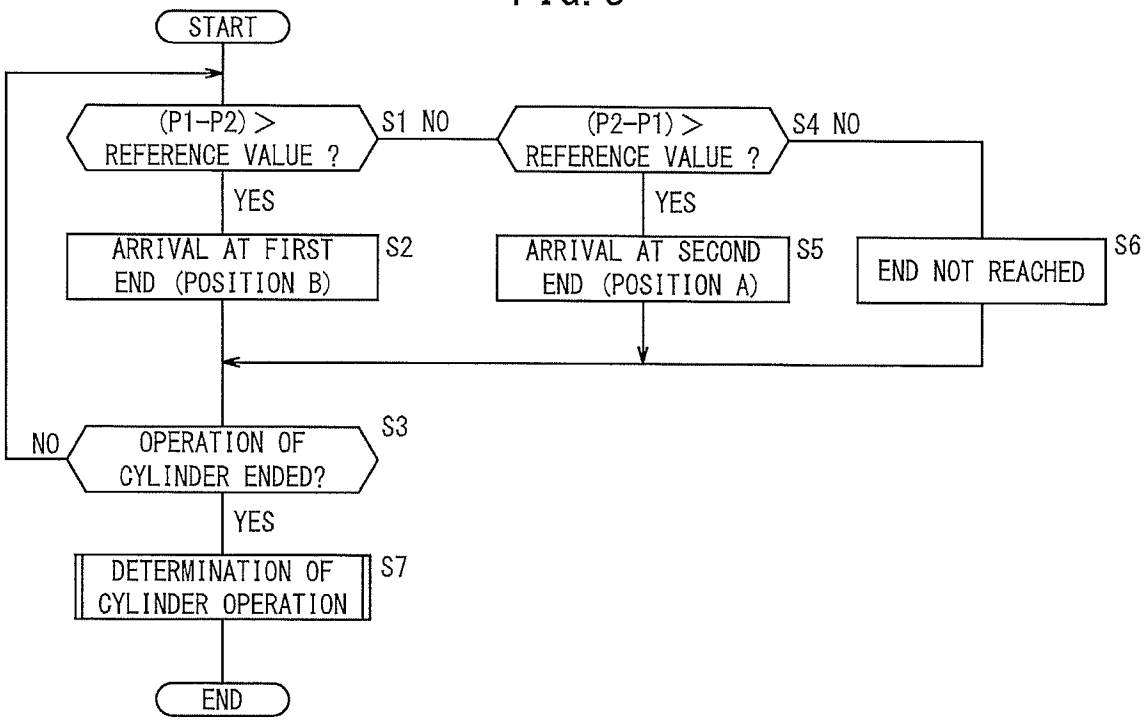
FIG. 3 is a flowchart of the present embodiment.

More specifically, a description will be given with reference to the flowcharts of FIGS. 3, 7 and 9, as well as the timing charts of FIGS. 4 to 6 and FIGS. 8 and 10. FIG. 3 is a flowchart showing the determination process carried out by the microcomputer 62.

Figure 4:
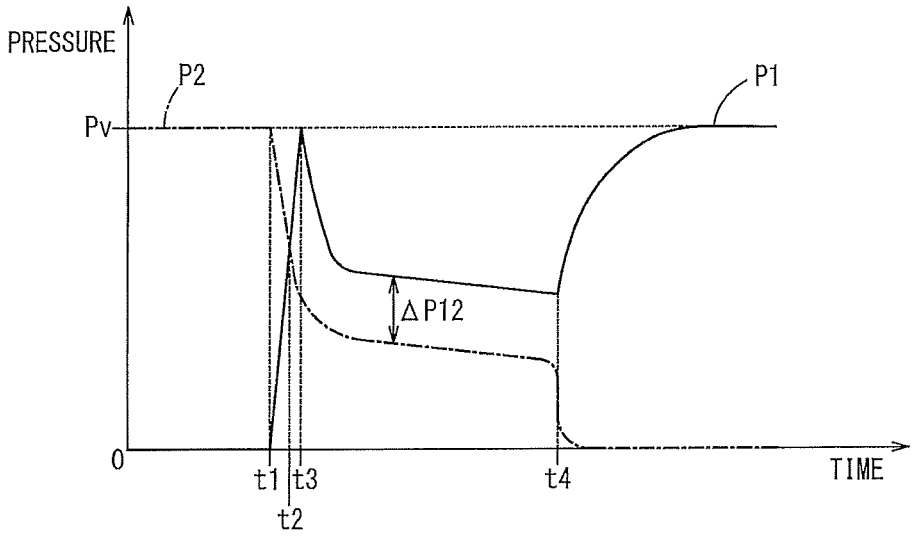
FIG. 4 is a timing chart showing changes over time of a first pressure value and a second pressure value.
Figure 5:
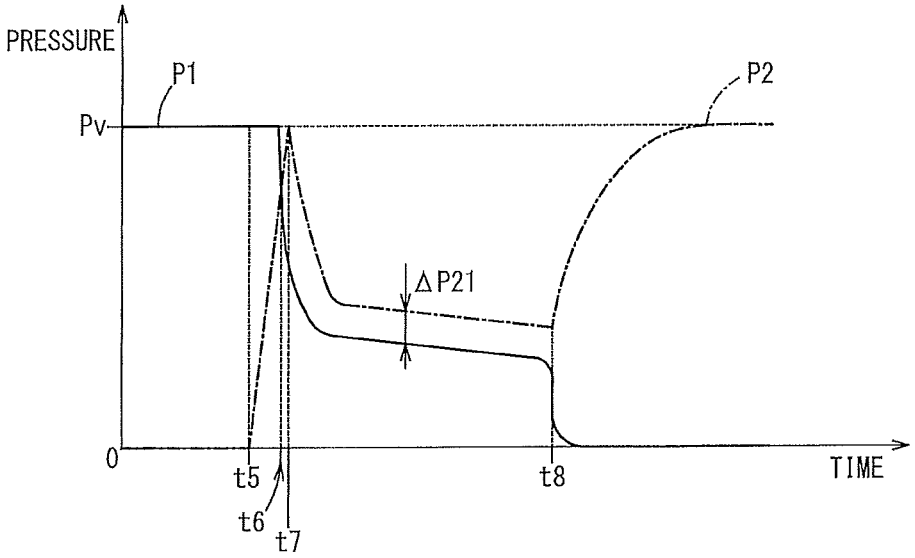
FIG. 5 is a timing chart showing changes over time of the first pressure value and the second pressure value.

FIG. 4 is a timing chart showing changes over time of the first pressure value P1 and the second pressure value P2 when the piston 16 and the piston rod 18 are advanced in the direction of the arrow D in the cylinder 12 of FIG. 1. FIG. 5 is a timing chart showing changes over time of the first pressure value P1 and the second pressure value P2 when the piston 16 and the piston rod 18 are retracted in the direction of the arrow C in the cylinder 12 of FIG. 1. The determination process of FIG. 3 will be described after first explaining the timing charts of FIGS. 4 and 5, respectively.

In the case of an advancing operation of the piston 16, as shown in FIG. 4, when the changeover valve 32 of FIG. 1 is off (in a time zone prior to time t1), pressure fluid is supplied from the fluid supply source 42 to the second cylinder chamber 22 via the pressure reducing valve 44, the supply port 38, the second connection port 36, and the second tube 30. As a result, the piston 16 is pressed toward the one end in the interior of the cylinder main body 14. On the other hand, since the first cylinder chamber 20 communicates with the atmosphere via the first tube 26 and the first connection port 34, the fluid in the first cylinder chamber 20 is discharged from the first tube 26 via the changeover valve 32. Accordingly, in the time zone prior to time t1, the first pressure value P1 is substantially zero, and the second pressure value P2 is a predetermined pressure value (the pressure value Pv of the pressure fluid that is output from the pressure reducing valve 44).

Next, at time t1, when a command signal is supplied from the microcomputer 62 in FIG. 2 to the solenoid 46, the changeover valve 32 is driven and turned on. As a result, the connection state of the changeover valve 32 is switched, and supply of pressure fluid is started from the fluid supply source 42 to the first cylinder chamber 20 via the pressure reducing valve 44, the supply port 38, the first connection port 34, and the first tube 26. On the other hand, the second cylinder chamber 22 communicates with the atmosphere via the second tube 30 and the second connection port 36, whereby the pressure fluid inside the second cylinder chamber 22 starts to be discharged to the exterior from the second tube 30 via the changeover valve 32.

Consequently, from time t1, the first pressure value P1 of the pressure fluid in the first tube 26 rapidly increases along with the elapse of time, and together therewith, the second pressure value P2 of the pressure fluid in the second tube 30 decreases rapidly along with the elapse of time. At time t2, the first pressure value P1 surpasses the second pressure value P2.

Thereafter, at time t3, the first pressure value P1 rises to a predetermined pressure value (for example, the second pressure value P2 (pressure value Pv) before time t1), whereupon the piston 16 starts to advance in the direction of the arrow D. In this case, when the piston 16 begins advancing in the direction of the arrow D, due to a volume change of the first cylinder chamber 20, the first pressure value P1 decreases from the pressure value Pv, and together therewith, the second pressure value P2 also decreases.

Moreover, in FIG. 4, although an example is illustrated in which the first pressure value P1 rises to the pressure value Pv at time t3, in actuality, cases exist in which the piston 16 starts to advance in the direction of the arrow D before the first pressure value P1 rises to the pressure value Pv. In the following descriptions, cases will be explained in which the piston 16 starts to advance or retract after the first pressure value P1 or the second pressure value P2 has risen to the pressure value Pv or a value in close proximity thereto.

During advancement of the piston 16, due to volume changes of the first cylinder chamber 20 and the second cylinder chamber 22, the first pressure value P1 and the second pressure value P2 gradually decrease together with the elapse of time. In this case, the first pressure value P1 and the second pressure value P2 decrease while maintaining a substantially constant first differential pressure ΔP12 (=P1−P2).

When the piston 16 reaches the other end (first end) inside the cylinder main body 14 at time t4, the volume of the second cylinder chamber 22 becomes substantially zero. Therefore, after time t4, the second pressure value P2 drops to substantially zero (atmospheric pressure), together with the first pressure value P1 rising to the pressure value Pv. More specifically, when the piston 16 reaches the other end inside the cylinder main body 14, the first differential pressure ΔP12 increases rapidly from a constant value.

On the other hand, in the case of a retracting operation of the piston 16, as shown in FIG. 5, when the changeover valve 32 of FIG. 1 is on (in a time zone prior to time t5), pressure fluid is supplied from the fluid supply source 42 to the first cylinder chamber 20 via the pressure reducing valve 44, the supply port 38, the first connection port 34, and the first tube 26, and the piston 16 is pressed toward the other end in the interior of the cylinder main body 14. On the other hand, since the second cylinder chamber 22 communicates with the atmosphere via the second tube 30 and the second connection port 36, the fluid in the second cylinder chamber 22 is discharged from the second tube 30 via the changeover valve 32. Accordingly, in the time zone prior to time t5, the first pressure value P1 remains at the pressure value Pv, and the second pressure value P2 is substantially zero.

Next, at time t5, when supply of the command signal from the microcomputer 62 in FIG. 2 to the solenoid 46 is suspended, driving of the changeover valve 32 is stopped and the changeover valve 32 is turned off. As a result, due to a spring restorative force of the changeover valve 32, the connection state of the changeover valve 32 is switched, and supply of pressure fluid is started from the fluid supply source 42 to the second cylinder chamber 22 via the pressure reducing valve 44, the supply port 38, the second connection port 36, and the second tube 30. On the other hand, the first cylinder chamber 20 communicates with the atmosphere via the first tube 26 and the first connection port 34, whereby the pressure fluid inside the first cylinder chamber 20 starts to be discharged to the exterior from the first tube 26 via the changeover valve 32.

Consequently, from time t5, the second pressure value P2 of the pressure fluid in the second tube 30 rapidly increases along with the elapse of time. Thereafter, the first pressure value P1 of the pressure fluid in the first tube 26 rapidly decreases along with the elapse of time. As a result, at time t6, the second pressure value P2 surpasses the first pressure value P1.

Thereafter, at time t7, the second pressure value P2 rises to a predetermined pressure value (for example, the pressure value Pv), whereupon the piston 16 starts to retract in the direction of the arrow C. In this case, due to a volume change of the second cylinder chamber 22, the second pressure value P2 decreases from the pressure value Pv, and together therewith, the first pressure value P1 also decreases.

During retraction of the piston 16, due to volume changes of the first cylinder chamber 20 and the second cylinder chamber 22, the first pressure value P1 and the second pressure value P2 gradually decrease together with the elapse of time. In this case, the first pressure value P1 and the second pressure value P2 decrease while maintaining a substantially constant second differential pressure ΔP21 (=P2−P1).

The absolute value of the first differential pressure ΔP12 in FIG. 4 and the absolute value of the second differential pressure ΔP21 in FIG. 5 are of different magnitudes from each other. This is caused by the fact that the piston rod 18 is connected to the side surface (right side surface) of the piston 16 in the second cylinder chamber 22 of FIG. 1, whereby the pressure receiving areas differ between the right side surface and the other side surface (left side surface) of the piston 16 in the first cylinder chamber 20.

When the piston 16 reaches the one end inside the cylinder main body 14 at time t8, the volume of the first cylinder chamber 20 becomes substantially zero. Therefore, after time t8, the first pressure value P1 drops to substantially zero (atmospheric pressure), together with the second pressure value P2 rising to the pressure value Pv. More specifically, when the piston 16 reaches the one end inside the cylinder main body 14, the second differential pressure ΔP21 increases rapidly from a constant value.

In addition, in the present embodiment, during reciprocating motion of the piston 16, by perceiving the abrupt change in the first differential pressure ΔP12 or the second differential pressure ΔP21 at the aforementioned times t4 and t8, it is determined whether or not the piston 16 has reached the one end (second end) or the other end (first end) inside the cylinder main body 14.

More specifically, the first pressure value P1, which is detected by the first pressure sensor 50 of FIG. 1, and the second pressure value P2, which is detected by the second pressure sensor 52, are input sequentially to the microcomputer 62 via the input/output interface unit 60 shown in FIG. 2. Thus, with each time that the first pressure value P1 and the second pressure value P2 are input thereto, the microcomputer 62 executes the determination process shown in FIG. 3.

More specifically, in step S1 of FIG. 3, the microcomputer 62 calculates the first differential pressure ΔP12 by subtracting the second pressure value P2 from the first pressure value P1. Next, the microcomputer 62 determines whether or not the first differential pressure ΔP12 has exceeded the first reference differential pressure ΔP12ref, which serves as a reference value that was stored in advance in the memory 68.

If ΔP12>ΔP12ref (step S1: YES), then in the following step S2, since the signs of ΔP12 and ΔP12ref are both positive, the microcomputer 62 advances the piston 16 from the one end to the other end inside the cylinder main body 14, and determines that the piston 16 has reached the other end (the piston rod 18 has arrived at the position B).

Then, the microcomputer 62 generates the first end signal which indicates that the piston 16 has arrived at the other end, and outputs the first end signal to the exterior via the input/output interface unit 60. Further, the microcomputer 62 displays the determination result on the display unit 66, and notifies the user concerning the arrival of the piston 16 at the first end. Furthermore, the microcomputer 62 stores the determination result and the first differential pressure ΔP12 that was used in the determination result in the memory 68.

In the following step S3, in the case that the reciprocating motion of the piston 16 is to be continued (step S3: NO), the microcomputer 62 repeatedly executes the determination process of step S1.

On the other hand, in the case that ΔP12≤ΔP12ref in step S1 (step S1: NO), then in the following step S4, the microcomputer 62 subtracts the first pressure value P1 from the second pressure value P2, and calculates the second differential pressure ΔP21. Moreover, the microcomputer 62 may simply invert the sign of the first differential pressure ΔP12 to thereby calculate the second differential pressure ΔP21 (=−ΔP12). Next, the microcomputer 62 determines whether or not the second differential pressure ΔP21 has exceeded the second reference differential pressure ΔP21ref, which serves as a reference value that was stored in advance in the memory 68.

If ΔP21>ΔP21ref (step S4: YES), then in the following step S5, since the signs of ΔP21 and ΔP21ref are both positive, the microcomputer 62 retracts the piston 16 from the other end to the one end inside the cylinder main body 14, and determines that the piston 16 has reached the one end (the piston rod 18 has arrived at the position A).

Then, the microcomputer 62 generates the second end signal which indicates that the piston 16 has arrived at the one end, and outputs the second end signal to the exterior via the input/output interface unit 60. Further, the microcomputer 62 displays the determination result on the display unit 66, and notifies the user concerning the arrival of the piston 16 at the second end. Furthermore, the microcomputer 62 stores the determination result and the second differential pressure ΔP21 that was used in the determination result in the memory 68.

Thereafter, in the following step S3, in the case that the reciprocating motion of the piston 16 is to be continued (step S3: NO), the microcomputer 62 returns to step S1, and repeatedly executes the determination process of step S1.

Further, in the case that ΔP21≤ΔP21ref in step S4 (step S4: NO), then in the following step S6, the microcomputer 62 determines that the piston 16 has not reached the one end or the other end inside the cylinder main body 14 (the piston 16 remains at a location between the one end and the other end). In this case, since the determination result in step S6 has already undergone the determination processes of steps S1 and S4, the microcomputer 62 stores in the memory 68 a determination result to the effect that the piston 16 resides at a location between the one end and the other end inside the cylinder main body 14, and further stores the first differential pressure ΔP12 and the second differential pressure ΔP21 that were used in the determination result.

Thereafter, in the following step S3, in the case that the reciprocating motion of the piston 16 is to be continued (step S3: NO), the microcomputer 62 returns to step S1, and repeatedly executes the determination process of step S1.

Accordingly, during reciprocating motion of the piston 16, at each time that the first pressure value P1 and the second pressure value P2 are input thereto, the microcomputer 62 repeatedly executes the judgment processes of steps S1 to S6, and determines whether or not the piston 16 has reached the one end or the other end inside the cylinder main body 14.

Further, during reciprocating motion of the piston 16, the timer 70 begins time measurement at the point in time at which supply of the command signal from the microcomputer 62 to the solenoid 46 was started, and the movement time T from such a point in time until the piston 16 arrives at the first end is measured. Consequently, along therewith, in parallel with the determination processes of steps S1 to S6 of FIG. 3, the microcomputer 62 performs a process of storing in the memory 68 the travel time T that was measured by the timer 70.

In the case that the reciprocating motion of the piston 16 is completed in step S3 (step S3: YES), then in the following step S7, the microcomputer 62 determines whether the operating state of the cylinder 12 is normal or abnormal, and furthermore, determines if the cylinder 12 is in a state (intermediate state) in which the performance has deteriorated from its initial state.

Figure 6:
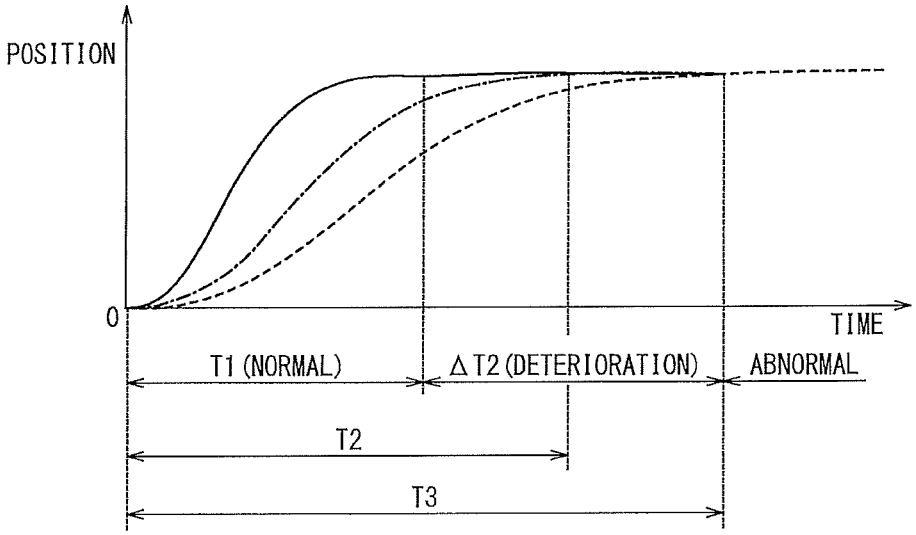
FIG. 6 is a timing chart showing a movement time of the cylinder.

FIG. 6 is a timing chart showing differences in the movement time T for cases in which the cylinder 12 is in a normal state (solid line), an intermediate state in which the performance of the cylinder 12 has deteriorated from its initial state (one-dot-dashed line), and an abnormal state in which an abnormality such as a failure or the like has occurred (dashed line).

If the operation of the cylinder 12 is in a normal state, the piston 16 moves between the one end and the other end inside the cylinder main body 14 within the movement time T1. Further, in an intermediate state in which the operation of the cylinder 12 is normal but the performance thereof has deteriorated from its initial state, the piston 16 moves between the one end and the other end in the cylinder main body 14 at a movement time T2, which is longer than the movement time T1. In this case, a time zone until elapse of a time period ΔT from the movement time T1 is a time zone (a time zone in an intermediate state prior to actual failure) during which a deterioration in performance of the cylinder 12 is exhibited. Furthermore, in a time zone in excess of the movement time T3 at which the time period ΔT has passed from the movement time T1, there is a possibility of an abnormal state, in which an abnormality such as a failure or the like of the cylinder 12 is taking place.

Conventionally, a determination process has been performed to determine whether the operation of the cylinder 12 is in a normal state or an abnormal state such as a failure or the like. However, because there has been no standard for making a judgment concerning an intermediate state prior to failure in which the performance of the cylinder 12 has deteriorated even though a failure has not actually occurred, a determination process with respect to such an intermediate state has not been carried out.

Thus, according to the present embodiment, a determination process of the operating condition of the cylinder 12 is performed, which also takes into account a determination process with respect to the intermediate states shown in FIGS. 7 to 10.

Descriptions will be given herein, respectively, concerning (1) a case in which a determination process is carried out with respect to the operating condition of the cylinder 12 using a first differential pressure ΔP12 and a second differential pressure ΔP21 (a first differential pressure ΔP12 during the time zone t3 to t4, a second differential pressure ΔP21 during the time zone t7 to t8) during reciprocating motion of the piston 16 (see FIGS. 7 and 8), and (2) a case in which a determination process is carried out with respect to the operating condition of the cylinder 12 using a movement time T during reciprocating motion of the piston 16 (see FIGS. 9 and 10).

First, the determination process shown in FIGS. 7 and 8 will be described.

Figure 7:
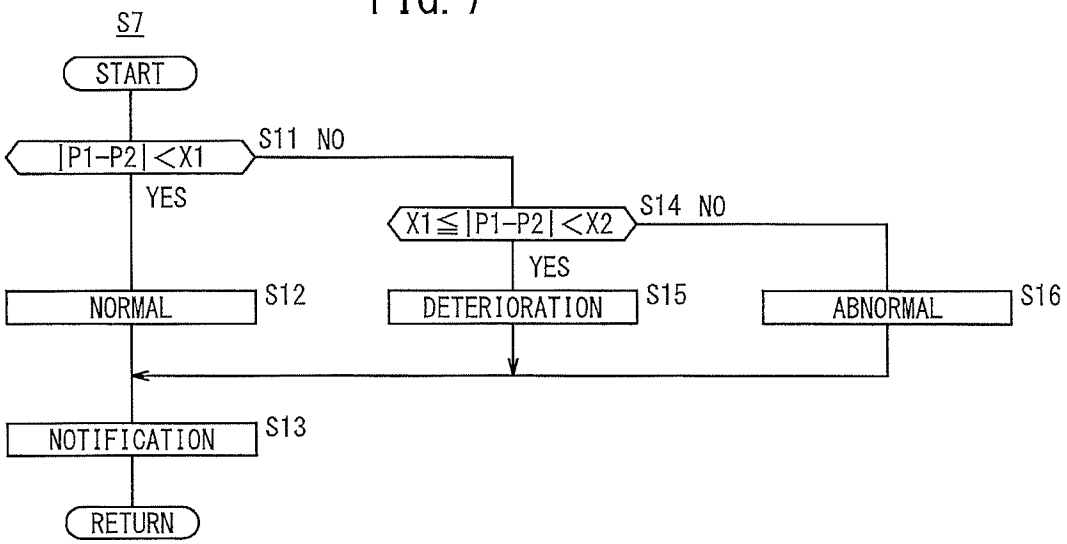
FIG. 7 is a flowchart showing the process of step S7 of FIG. 3.

In step S11 of FIG. 7, the microcomputer 62 reads out from the memory 68 the first differential pressure ΔP12 and the second differential pressure ΔP21, which correspond to the determination result of step S6 of FIG. 3. Next, the microcomputer 62 determines whether or not the first differential pressure ΔP12 or the second differential pressure ΔP21 is less than the first differential pressure threshold value X1.

If ΔP12 (or ΔP21)<X1 (step S11: YES), then in the following step S12, the microcomputer 62 determines that the operation of the cylinder 12 is in a normal state, and outputs to the exterior via the input/output interface unit 60 a notification signal indicative of a determination result to the effect that the operation was in a normal state (step S13). Further, in step S13, the microcomputer 62 outputs the notification signal to the display unit 66, and provides a notification to the user by displaying on the display unit 66 that the operation of the cylinder 12 is in a normal state.

If ΔP12 (or ΔP21)≥X1 in step S11 (step S11: NO), then in the following step S14, the microcomputer 62 determines whether or not X1≤ΔP12 (or ΔP21)<X2.

If the determination result was affirmative in step S14 (step S14: YES), then the microcomputer 62 determines that, although operation of the cylinder 12 is normal, the cylinder 12 is in an intermediate state in which the performance thereof is deteriorated from its initial state (step S15). Thereafter, in step S13, the microcomputer 62 outputs to the exterior via the input/output interface unit 60 a notification signal indicative of the determination result to the effect that the performance of the cylinder 12 is in an intermediate state, and further outputs the notification signal to the display unit 66, thereby providing a notification to the user by displaying on the display unit 66 the deterioration in performance (intermediate state) of the cylinder 12.

Furthermore, if ΔP12 (or ΔP21)≥X2 in step S14 (step S14: NO), the microcomputer 62 determines that the cylinder 12 is in an abnormal state (a failure is occurring) (step S16). Consequently, in step S13, the microcomputer 62 outputs to the exterior via the input/output interface unit 60 a notification signal indicative of the determination result to the effect that the cylinder 12 is experiencing a failure, and further outputs the notification signal to the display unit 66, thereby providing a notification to the user by displaying on the display unit 66 the failure (abnormal state) of the cylinder 12.

Next, the determination process shown in FIGS. 9 and 10 will be described.

Figure 9:
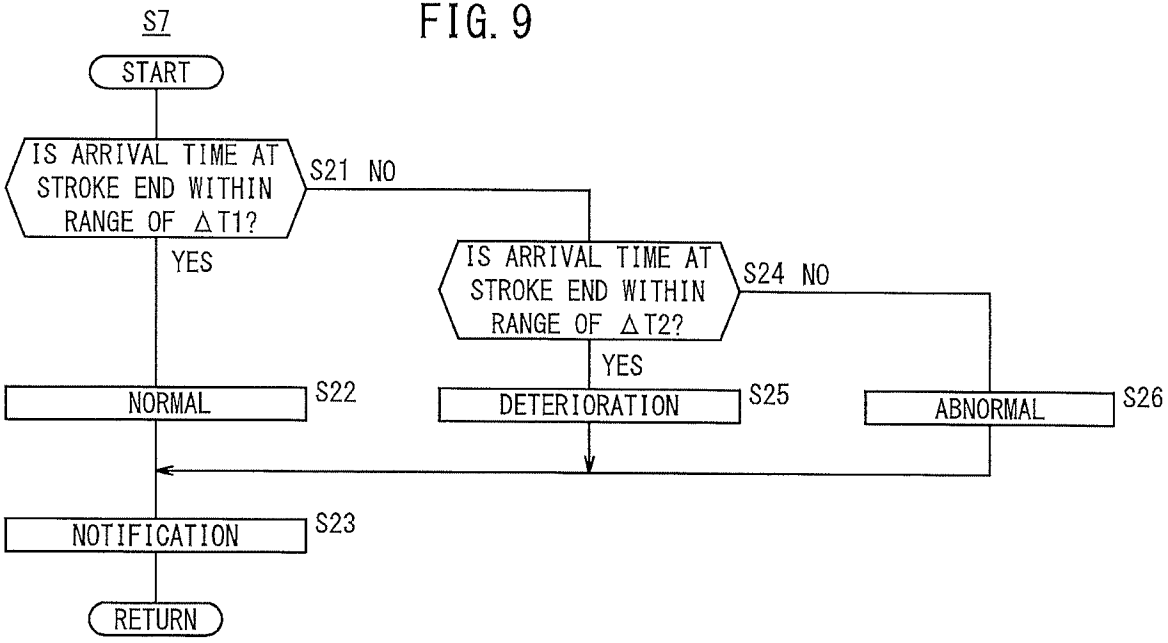
FIG. 9 is a flowchart showing another process of step S7 of FIG. 3.

In the determination process using the movement time T, in step S21 of FIG. 9, the microcomputer 62 reads out the movement time T from the memory 68, and makes a determination as to whether or not the movement time T lies within the first time period threshold value ΔT1.

If the movement time T lies within the first time period threshold value ΔT1 (step S21: YES), then in the following step S22, the microcomputer 62 determines that the operation of the cylinder 12 is in a normal state, and outputs to the exterior via the input/output interface unit 60 a notification signal indicative of a determination result to the effect that the operation was in a normal state (step S23). Further, in step S23, the microcomputer 62 outputs the notification signal to the display unit 66, and provides a notification to the user by displaying on the display unit 66 that the operation of the cylinder 12 is in a normal state.

If the movement time T deviates from the first time period threshold value ΔT1 in step S21 (step S21: NO), then in the following step S24, the microcomputer 62 determines whether or not the movement time T lies within the range of a second time period threshold value ΔT2.

If the movement time T lies within the range of the second time period threshold value ΔT2 (step S24: YES), then the microcomputer 62 determines that, although operation of the cylinder 12 is normal, the cylinder 12 is in an intermediate state in which the performance thereof is deteriorated from its initial state (step S25). Thereafter, in step S23, the microcomputer 62 outputs to the exterior via the input/output interface unit 60 a notification signal indicative of the determination result to the effect that the performance of the cylinder 12 is in an intermediate state, and further outputs the notification signal to the display unit 66, thereby providing a notification to the user by displaying on the display unit 66 the deterioration in performance (intermediate state) of the cylinder 12.

Furthermore, if the movement time T deviates from the second time period threshold value ΔT2 in step S24 (step S24: NO), the microcomputer 62 determines that the cylinder 12 is in an abnormal state (a failure is occurring) (step S26). Consequently, in step S23, the microcomputer 62 outputs to the exterior via the input/output interface unit 60 a notification signal indicative of the determination result to the effect that the cylinder 12 is experiencing a failure, and further outputs the notification signal to the display unit 66, thereby providing a notification to the user by displaying on the display unit 66 the failure (abnormal state) of the cylinder 12.

Accordingly, with the processes of FIGS. 7 to 10, in any of the determination results of the normal state, the intermediate state, or the abnormal state, a notification is provided by outputting the notification signal to the exterior, or by displaying the notification on the display unit 66. Therefore, on the basis of the content of the notification signal or the displayed content on the display unit 66, for example, if the determination result is an abnormal state, an administrator or a user of an upper level system can take an appropriate remedial measure, such as stopping the fluid system including the cylinder 12.

Further, according to the present embodiment, either one of the process of FIGS. 7 and 8 or the process of FIGS. 9 and 10 is performed. However, since the differential pressures ΔP12, ΔP21 and the movement time T are stored in the memory 68, after completion of the reciprocating motion of the piston 16, the microcomputer 62 is capable of executing both the process of FIGS. 7 and 8 and the process of FIGS. 9 and 10, and thus can carry out both processes to determine the normal state, the intermediate state, or the abnormal state.

[3. Effects and Advantages of the Present Embodiment]

With the monitoring device 10 according to the present embodiment, the pressure (first pressure value P1 inside the first tube 26, second pressure value P2 inside the second tube 30) in the fluid supply path from the fluid supply source 42 to the first cylinder chamber 20 or the second cylinder chamber 22 is detected, whereby it becomes possible to detect the pressure value of the first cylinder chamber 20 or the second cylinder chamber 22. Consequently, according to the present invention, it is unnecessary to install sensors in the vicinity of the cylinder 12.

Further, the microcomputer 62 determines whether or not the reciprocating motion operation of the piston 16 is in the intermediate state, on the basis of the first differential pressure ΔP12 and the second differential pressure ΔP21 between the first pressure value P1, which is dependent on the pressure value of the first cylinder chamber 20, and the second pressure value P2, which is dependent on the pressure value of the second cylinder chamber 22. In this manner, by adding such a determination process (failure prediction function) with respect to the intermediate state, even if the cylinder 12 is operating normally, it is possible to determine the intermediate state in which the performance of the cylinder has deteriorated from its initial state.

Further, during reciprocating motion of the piston 16, the first pressure sensor 50 detects the first pressure value P1, and the second pressure sensor 52 detects the second pressure value P2, and the microcomputer 62 calculates and stores in the memory 68 the first differential pressure ΔP12 and the second differential pressure ΔP21. Then, at completion of the reciprocating motion operation, and on the basis of the first differential pressure ΔP12 and the second differential pressure ΔP21 that are stored in the memory 68, the microcomputer 62 determines whether or not the reciprocating motion operation is in the intermediate state.

In accordance with this feature, since the first differential pressure ΔP12 and the second differential pressure ΔP21, which were calculated during reciprocating motion of the piston 16, are analyzed at completion of the reciprocating motion operation, it is possible to determine with high accuracy whether or not the reciprocating motion operation is in the intermediate state. As a result, the reliability of the determination result can be enhanced.

Further, it is known that the first differential pressure ΔP12 and the second differential pressure ΔP21 during reciprocating motion of the piston 16 remain substantially constant. Therefore, a change in the level of the first differential pressure ΔP12 and the second differential pressure ΔP21 can be regarded as indicating that an abnormality has occurred, such as a deterioration in performance or a breakdown of (components related to operation of) the cylinder 12. Therefore, by carrying out such a determination on the basis of the first differential pressure ΔP12 and the second differential pressure ΔP21, it is possible for the microcomputer 62 to perform the determination process highly efficiently with respect to the reciprocating motion operation.

Further, because the first pressure sensor 50 is provided in the first tube 26, together with the second pressure sensor 52 being provided in the second tube 30, it is unnecessary to install sensors, as well as wiring for such sensors, in the vicinity of the cylinder 12. As a result, it is possible for the cylinder 12 to be used suitably in facilities related to food preparation, and it is possible to avoid the occurrence of corrosion or the like of sensors and wiring in a cleaning process for the facilities.

In addition, by performing the determination process shown in FIG. 7, it becomes possible for the microcomputer 62 to carry out determinations in relation to the reciprocating motion operation, respectively, for the normal state, the intermediate state, and the abnormal state. Further, because the determination process (failure prediction function) with respect to the intermediate state is carried out using as reference values the first differential pressure threshold value X1 and the second differential pressure threshold value X2, even during normal operation, it is possible to easily determine the intermediate state in which the performance has deteriorated from the initial state.

Further, the timer 70 measures as the movement time T a time zone from a point in time at which the piston 16 starts moving from the one end or the other end inside the cylinder main body 14 to a point in time at which the piston 16 reaches the other end or the one end inside the cylinder main body 14 and the first differential pressure ΔP12 and the second differential pressure ΔP21 increase from the constant value. The microcomputer 62 determines whether or not the reciprocating motion operation of the piston 16 is in the intermediate state on the basis of the movement time T.

If the movement time T changes, such a change can be regarded as indicating that an abnormality, such as a deterioration in performance or a breakdown of (components related to operation of) the cylinder 12 has occurred. Therefore, based on the movement time T, the microcomputer 62 can carry out the determination process highly efficiently with respect to the reciprocating motion operation.

In addition, by performing the determination process shown in FIG. 9, the microcomputer 62 is capable of carrying out determinations in relation to the reciprocating motion operation, respectively, for the normal state, the intermediate state, and the abnormal state. Further, because the determination process (failure prediction function) with respect to the intermediate state is carried out using as reference values the first time period threshold value ΔT1 and the second time period threshold value ΔT2, even during normal operation, it is possible to easily determine the intermediate state in which the performance has deteriorated from the initial state.

Further, according to the present embodiment, by treating the above intermediate state as a warning state with respect to an abnormality such as a failure or the like, before the cylinder 12 actually suffers from a failure, a deterioration in performance of the cylinder 12 can be notified to an upper level system or the like of the monitoring device 10. In accordance with this feature, it is possible to provide a notification to the user concerning a maintenance timing for the cylinder 12, and to minimize downtime of the system as a whole.

The present invention is not limited to the embodiment described above, and it is a matter of course that various alternative or additional configurations could be adopted therein without departing from the essence and gist of the present invention.

What is claimed is:

1. An operating condition monitoring device for a cylinder, in which a first cylinder chamber is formed between a piston and one end in an interior of a cylinder main body, a second cylinder chamber is formed between the piston and another end in the interior of the cylinder main body, and fluid is supplied from a fluid supply source to the first cylinder chamber, or fluid is supplied from the fluid supply source to the second cylinder chamber, whereby the piston which is connected to a piston rod undergoes reciprocating motion between the one end and the other end inside the cylinder main body, comprising:

a first pressure detection unit adapted to detect a pressure value of the first cylinder chamber;

a second pressure detection unit adapted to detect a pressure value of the second cylinder chamber;

a differential pressure calculating unit adapted to calculate a differential pressure between the pressure value detected by the first pressure detection unit and the pressure value detected by the second pressure detection unit;

a determination unit adapted to determine, based on the differential pressure calculated by the differential pressure calculating unit, whether or not the reciprocating motion operation of the piston is in an intermediate state between a normal state and an abnormal state; and a storage unit adapted to store the calculated differential pressure, in an event that, during reciprocating motion of the piston, the first pressure detection unit has detected the pressure value of the first cylinder chamber, the second pressure detection unit has detected the pressure value of the second cylinder chamber, and the differential pressure calculating unit has calculated the differential pressure of the respective pressure values;

wherein, at completion of the reciprocating motion operation, the determination unit determines whether or not the reciprocating motion operation is in the intermediate state based on the differential pressure that is stored in the storage unit.

2. The operating condition monitoring device for a cylinder according to claim 1, wherein:

the fluid supply source supplies fluid to the first cylinder chamber through a first tube, or supplies fluid to the second cylinder chamber through a second tube;

the first pressure detection unit detects a first pressure value of the fluid inside the first tube, which is dependent on the pressure value of the first cylinder chamber;

the second pressure detection unit detects a second pressure value of the fluid inside the second tube, which is dependent on the pressure value of the second cylinder chamber; and the differential pressure calculating unit calculates a differential pressure between the first pressure value and the second pressure value.

3. The operating condition monitoring device for a cylinder according to claim 1, wherein the determination unit:

determines that the reciprocating motion operation of the piston is in the normal state, in a case that the differential pressure is less than a first differential pressure threshold value;

determines that the reciprocating motion operation is in the intermediate state in which a degradation in performance of the cylinder has occurred although the reciprocating motion operation is normal, in a case that the differential pressure is greater than or equal to the first differential pressure threshold value and less than a second differential pressure threshold value; and determines that the reciprocating motion operation is in the abnormal state, in the case that the differential pressure is greater than or equal to the second differential pressure threshold value.

4. The operating condition monitoring device for a cylinder according to claim 1, further comprising a timer unit adapted to measure a movement time of the piston between the one end and the other end inside the cylinder main body;

wherein the timer unit measures as the movement time a time zone from a point in time at which the piston starts moving from the one end or the other end inside the cylinder main body to a point in time at which the piston reaches the other end or the one end inside the cylinder main body and the differential pressure increases from a constant value; and the determination unit determines whether or not the reciprocating motion operation of the piston is in the intermediate state based on the movement time.

5. The operating condition monitoring device for a cylinder according to claim 4, wherein the determination unit:

determines that the reciprocating motion operation of the piston is in the normal state, in a case that the movement time lies within a first time period threshold value;

determines that the reciprocating motion operation is in the intermediate state in which a degradation in performance of the cylinder has occurred although the reciprocating motion operation is normal, in a case that the movement time deviates from the first time period threshold value and lies within a second time period threshold value; and determines that the reciprocating motion operation is in the abnormal state, in a case that the movement time deviates from the second time period threshold value.

6. The operating condition monitoring device for a cylinder according to claim 1, further comprising a notification unit adapted to provide a notification of a determination result of the determination unit.

* * * * *